US007374160B2

(12) United States Patent
Doi

(10) Patent No.: US 7,374,160 B2
(45) Date of Patent: May 20, 2008

(54) SHEET PROCESSING APPARATUS

(75) Inventor: Raita Doi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 289 days.

(21) Appl. No.: 11/072,458

(22) Filed: Mar. 7, 2005

(65) Prior Publication Data

US 2006/0027959 A1 Feb. 9, 2006

(30) Foreign Application Priority Data

Aug. 9, 2004 (JP) ..... P2004-231949

(51) Int. Cl.
*B65H 37/04* (2006.01)

(52) U.S. Cl. ..... 270/37; 270/32; 270/58.07; 270/58.08; 270/58.09; 270/58.11

(58) Field of Classification Search ..... 270/32, 270/37, 58.07, 58.08, 58.09, 58.11; 399/407, 399/408, 410; 493/26
See application file for complete search history.

(56) References Cited

U.S. PATENT DOCUMENTS 6,003,853 A * 12/1999 Nakazawa et al. ..... 270/58.11
6,575,447 B2 * 6/2003 Yoshie et al. ..... 270/58.07
7,121,993 B2 * 10/2006 Matsumoto ..... 493/434

FOREIGN PATENT DOCUMENTS

JP 2002-068518 3/2002

* cited by examiner

*Primary Examiner*—Gene O. Crawford
*Assistant Examiner*—Leslie A Nicholson, III
(74) *Attorney, Agent, or Firm*—Morgan, Lewis & Bockius LLP

(57) ABSTRACT

A sheet processing apparatus has a stapler for stapling a center of plural stacked sheets; a sheet folding mechanism for folding a set of the stapled sheets in half; a sheet recognizing portion for recognizing the number of sheets forming the set of sheets; a sheet transport mechanism for transporting the set of stapled sheets to a position where the center of the set of sheets is folded by the sheet folding mechanism; a transport distance determination table for associating the number of sheets with a distance by which the set of sheets is to be transported by the sheet transport mechanism; and a sheet transport control portion for transporting the set of sheets by a distance determined by the transport distance determination table according to the number of sheets through use of the sheet transport mechanism.

6 Claims, 4 Drawing Sheets

SHEET PROCESSING APPARATUS

BACKGROUND OF THE INVENTION

1. Field of the Invention

The present invention relates to a sheet processing apparatus which stacks pieces of paper sequentially fed one by one, binds the center of the pieces of stacked paper, and folds the thus-bound set of paper in half.

2. Description of the Related Art

Some conventional copying machines or printers have a processing function for stapling plural pieces of stacked paper to form a set, binding the set of stapled sheets, and folding the center of the set of stapled sheets paper in half.

In such a copying machine or printer capable of effecting such a folding operation, pieces of paper are temporarily stored in a tray called a compiler tray for aligning paper which is an object of stapling. Subsequently, the sheets are transported to a stapling position for stapling the center of the paper. After having been stapled, the set of pieces of paper is transported to a folding position where the set is folded in half by means of the folding mechanism.

In such a copying machine or printer, the stapled position of the set of pieces of paper sometimes becomes deviated from the position of the folding line of the set of pieces of paper to be used for folding operation.

There is proposed inhibition of occurrence of a deviation by accurately transporting the pieces of paper to the stapling position from the compiler tray (refer to JP-A-2002-068518).

In the above-described proposal, it is known that, even when the center of paper is stapled, a deviation between the stapled position and a folded line becomes larger as the number of pieces of paper bound by the stapler is increased. This results in a problem of poor appearance.

The above-described problem arises not only when the recording paper whose center is bound is folded in two half, but also when center-bound sheet-like substances other than the recording paper are folded in half.

SUMMARY OF THE INVENTION

The present invention has been conceived in view of the circumstances and provides a sheet processing apparatus which prevents occurrence of a displacement between a stapled position on a set of sheets and the position of a folded line of the set of sheets made by folding.

According to an aspect of the present invention, there is provided a sheet processing apparatus which stacks sheets sequentially fed one by one, binds a center of plural stacked sheets, and folds the thus-bound set of sheets in half, the apparatus including: a stapler which binds the center of the plurality of stacked sheets; a sheet folding mechanism which folds the set of sheets bound by the stapler in half; a sheet number recognizing portion which recognizes a number of sheets forming the set of sheets; a sheet transport mechanism which transports the set of sheets bound by the stapler to a position where a center of the set of sheets is folded by the sheet folding mechanism; and a sheet transfer control portion which transports the set of sheets by a transport distance determined according to the number of sheets forming the set of sheets, which is recognized by the sheet number recognizing portion.

The sheet transfer control portion may include a transport distance determination table in which the number of sheets forming the set of sheets is associated with a transport distance by which the sheet transport mechanism transports the set of sheets.

BRIEF DESCRIPTION OF THE DRAWING

An embodiment of the present invention will be described in detail based on the following figures, wherein.

DETAILED DESCRIPTION OF THE INVENTION

An embodiment of a sheet processing apparatus of the present invention will be described hereinafter.

Figure 1:
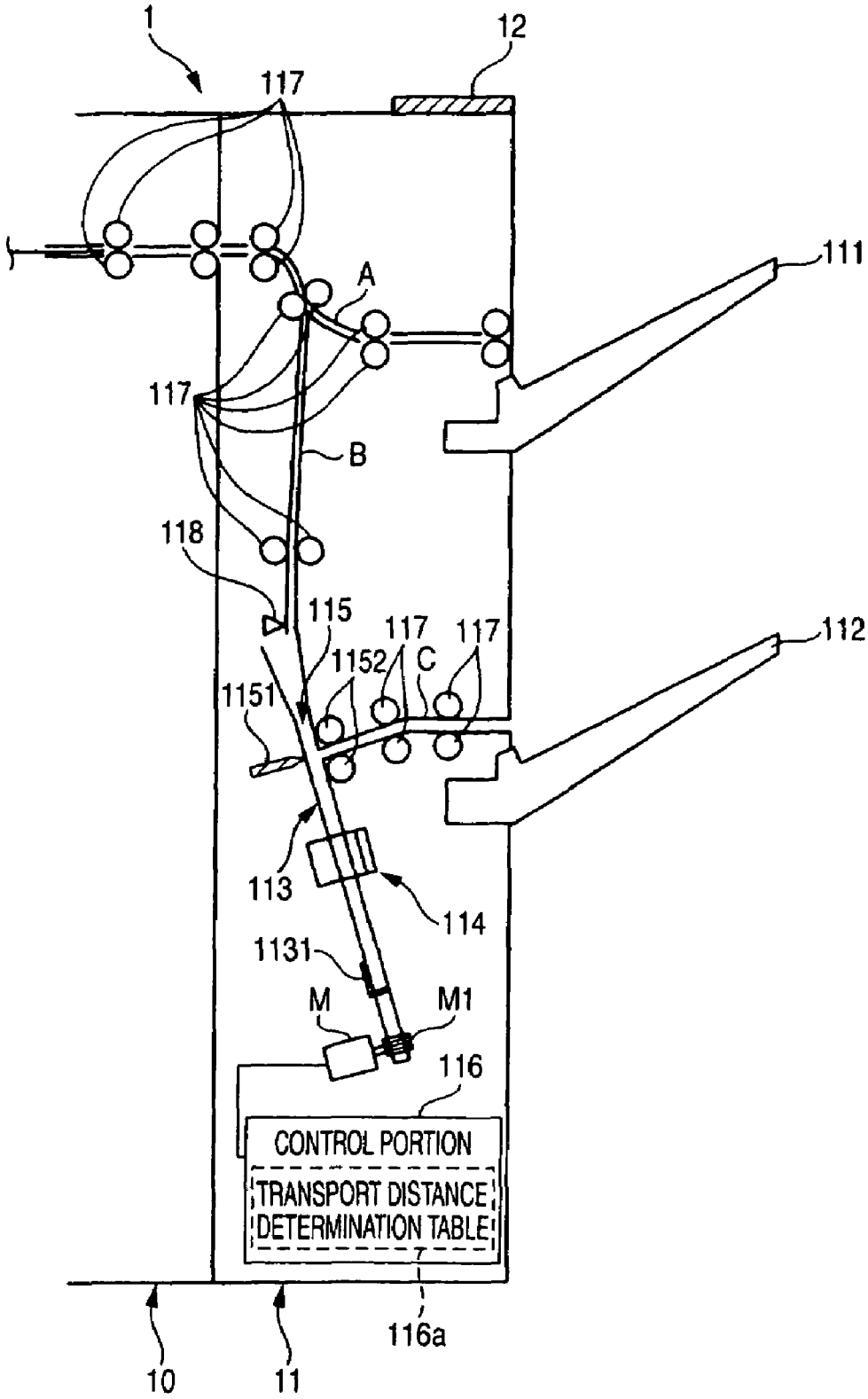
FIG. 1 is a schematic block diagram of an embodiment of a sheet processing apparatus according to the present invention.

FIG. 1 is a schematic block diagram showing an embodiment of a sheet processing apparatus according to the present invention.

FIG. 1 shows a sheet processing apparatus 11 of the embodiment. An image forming apparatus 10 is shown to be disposed on the left of the sheet processing apparatus 11. An image forming system 1 is configured with the image forming apparatus 10 and the sheet processing apparatus 11.

In the image forming system 1, recording paper onto which an image is formed by the image forming apparatus 10 is transported to the sheet processing apparatus 11. The sheet processing apparatus 11 has a first transport path A and a second transport path B. By means of the first transport path A, the recording paper transported from the image forming apparatus 10 is ejected, without being subjected to any processing, to an upper first paper exit tray 111 of two paper exit trays disposed on the right of the sheet processing apparatus 11. In order to perform binding operation for stapling the center of the set of sheets and folding operation for folding the center-bound set of sheets in half, the second transport path B is branched downward from the first transport path A to a position below the sheet processing apparatus 11.

The sheet processing apparatus 11 includes a compiler tray 113 for aligning the recording paper transported by way of the second transport path B for processing; a stapler 114 for binding the center of the recording paper aligned by the compiler tray 113; and a folding mechanism 115 for folding the set of stapled paper in half.

The sheet processing apparatus 11 includes a control portion 116 for controlling the overall operation of the sheet processing apparatus 11; a third transport path C for ejecting the set of paper folded in half by the folding mechanism 115 to a second paper exit tray 112 located below the first paper exit tray 111; and a photosensor 118 for counting the number of pieces of paper fed into the compiler tray 113.

The compiler tray 113 is provided with a positioning member 1131 for moving the aligned recording paper. The positioning member 1131 is provided with a rack (not shown), and this rack meshes with a pinion gear M1 attached to the rotary shaft of a stepping motor M. In this sheet processing apparatus 11, movement of the positioning member 1131 on the compiler tray 113 is controlled by controlling the rotational angle of the stepping motor M.

The stapler 114 performs stapling operation upon receipt of a command from the control portion 116.

The folding mechanism 115 is constituted of a folding roller 1152 and a knife edge 1151 for pressing a bound portion of the center-bounded set of paper into a clearance in the folding roller 1152. FIG. 1 shows transport rollers 117 for transporting recording paper.

Movement of paper to the stapling position where stapling is performed by the stapler 114 and movement of the set of paper from the stapling position to the folding position where folding is performed by the folding mechanism 115 are controlled by the rotation command from the control portion 116 to the stepping motor M. Information about a transport distance is stored in the transport distance determination table of the control portion 116. FIG. 1 shows that a touch panel 12 for operation purpose of the image forming system 1 is attached to an upper surface of the sheet processing apparatus 11.

FIG. 2 is a view showing a positional change in the positioning member of the compiler tray. In FIG. 2, A4, B4, and A3 are taken as typical sizes of recording paper.

Figures 2A, 2B, 2C:
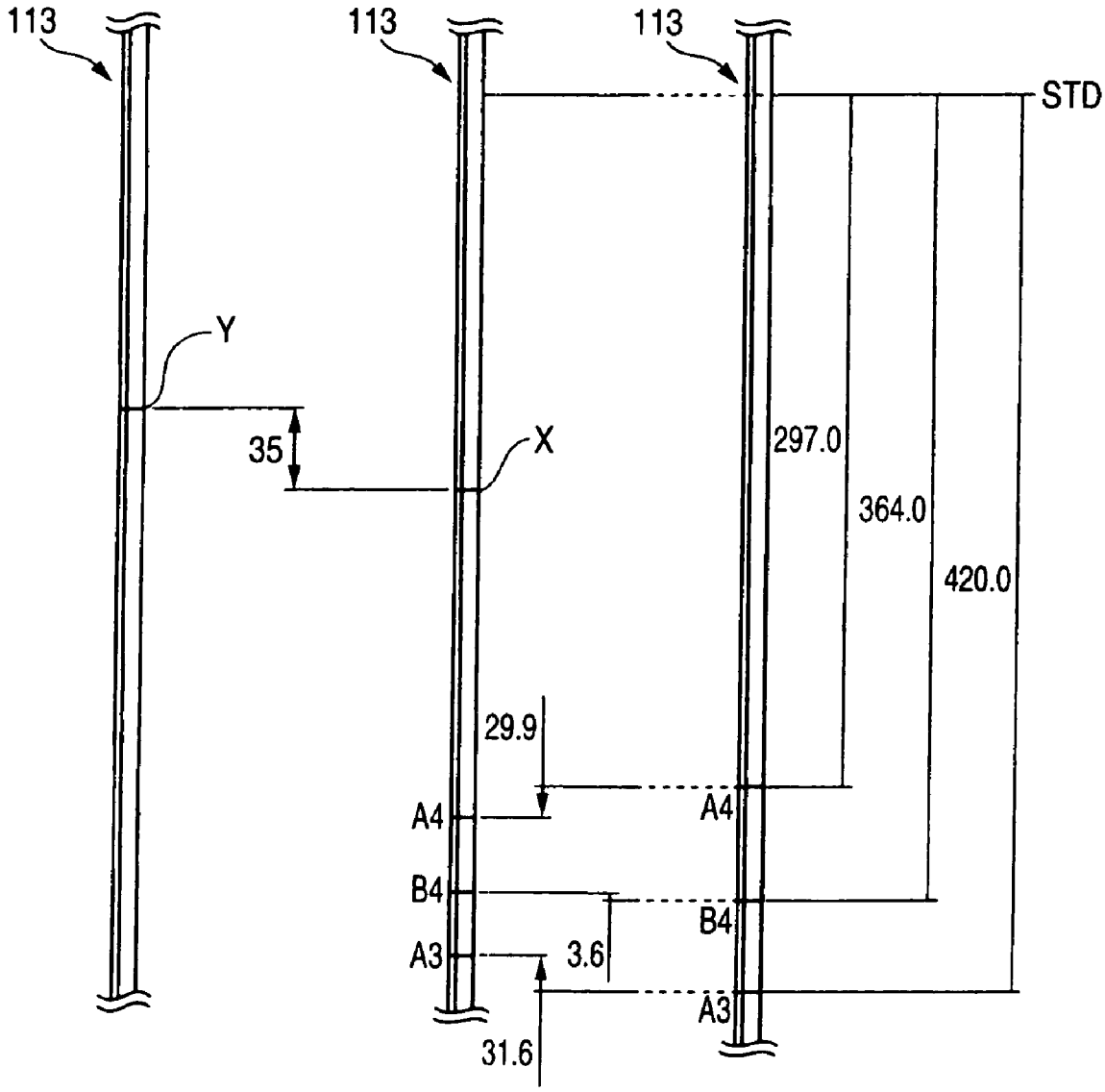
FIGS. 2A to 2C are views showing positional changes in a positioning member in a compiler tray.

FIG. 2A shows that the position of the positioning member 1131 achieved when the recording paper transported over the second transport path B is aligned is set in accordance with the paper size. In the case where A4-size recording paper is to be processed, the positioning member 1131 moves to a position 297.0 mm away from STD, which is the upper end reference position. In the case of B4-size recording paper, the positioning member 1131 moves to a position 364.0 mm away from the STD. In the case of A3-size recording paper, the positioning member 1131 moves to a position 420.0 mm away from the STD.

FIG. 2B shows layout of the positioning member 1131 when the aligned recording paper is stapled. In the sheet processing apparatus 11 of this embodiment, in the case of A4-size recording paper, the positioning member 1131 is lowered by 29.9 mm from the position shown in FIG. 2A. In the case of B4-size recording paper, the positioning member 1131 is elevated by 3.6 mm from the position shown in FIG. 2A. In the case of A3-size recording paper, the positioning member 1131 is elevated by 31.6 mm from the position shown in FIG. 2A. In this sheet processing apparatus 11, the center of recording paper is stapled by changing the position of the recording paper in accordance with the size of recording paper. The position X shown in FIG. 2B is the position where stapling is to be performed.

As shown in FIG. 2C, folding of the set of stapled paper is performed at a position Y spaced 35 mm away from the stapling position X.

Here, when the set of stapled paper is moved to the folding position Y in this sheet processing apparatus 11, a command is input to the stepping motor M such that the positioning member 1131 is elevated by $(35+\alpha)$ mm from the position shown in FIG. 2B. This factor $\alpha$ is an adjustment value that changes in accordance with the number of pieces of paper constituting the set of paper.

FIG. 3 shows a graph of a control portion of the sheet processing apparatus of this embodiment, the graph pertaining to a transport distance determination table to be referred to when the set of stapled paper is moved to the folding position Y.

Figure 3A:
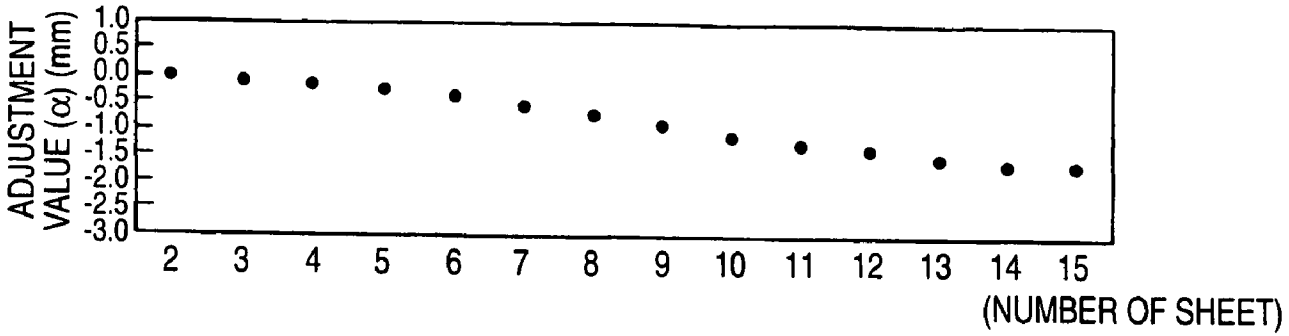
FIGS. 3A to 3C are graphs pertaining to details of a transport distance determination table of a control portion of the sheet processing apparatus according to the embodiment.

In FIG. 3A, a mean adjustment value $\alpha$ obtained as a result of the sheet processing apparatus 11 of this embodiment having conducted a test while taking predetermined recording paper as an object is indicated in dots, in increments of one piece of paper of the pieces of paper constituting the set of paper. From this test result, a relationship between the adjustment value $\alpha$ pertaining to the predetermined recording paper and the number of pieces of paper can be approximated by a linear expression.

Figure 3B:
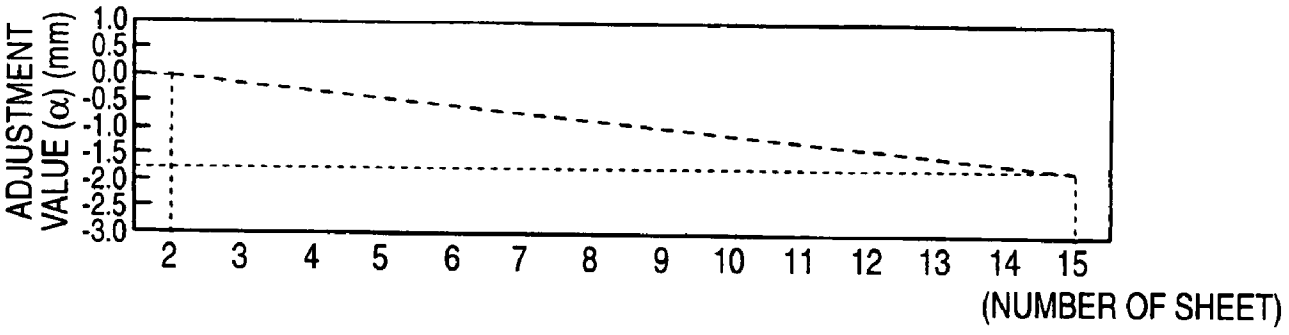

FIG. 3B shows details of the transport distance determination table shown in FIG. 3A, wherein the table is expressed by dotted lines of linear expression determined by adjusting a mean adjustment value $\alpha$ (0.0) obtained when the set of paper consists of two pieces of paper and a mean adjustment value $\alpha$ (−1.7) obtained when the set of paper consists of 15 pieces of paper. The transport distance determination table whose details are shown in FIG. 3B is registered in a control portion 116 before shipment from a factory.

Figure 4:
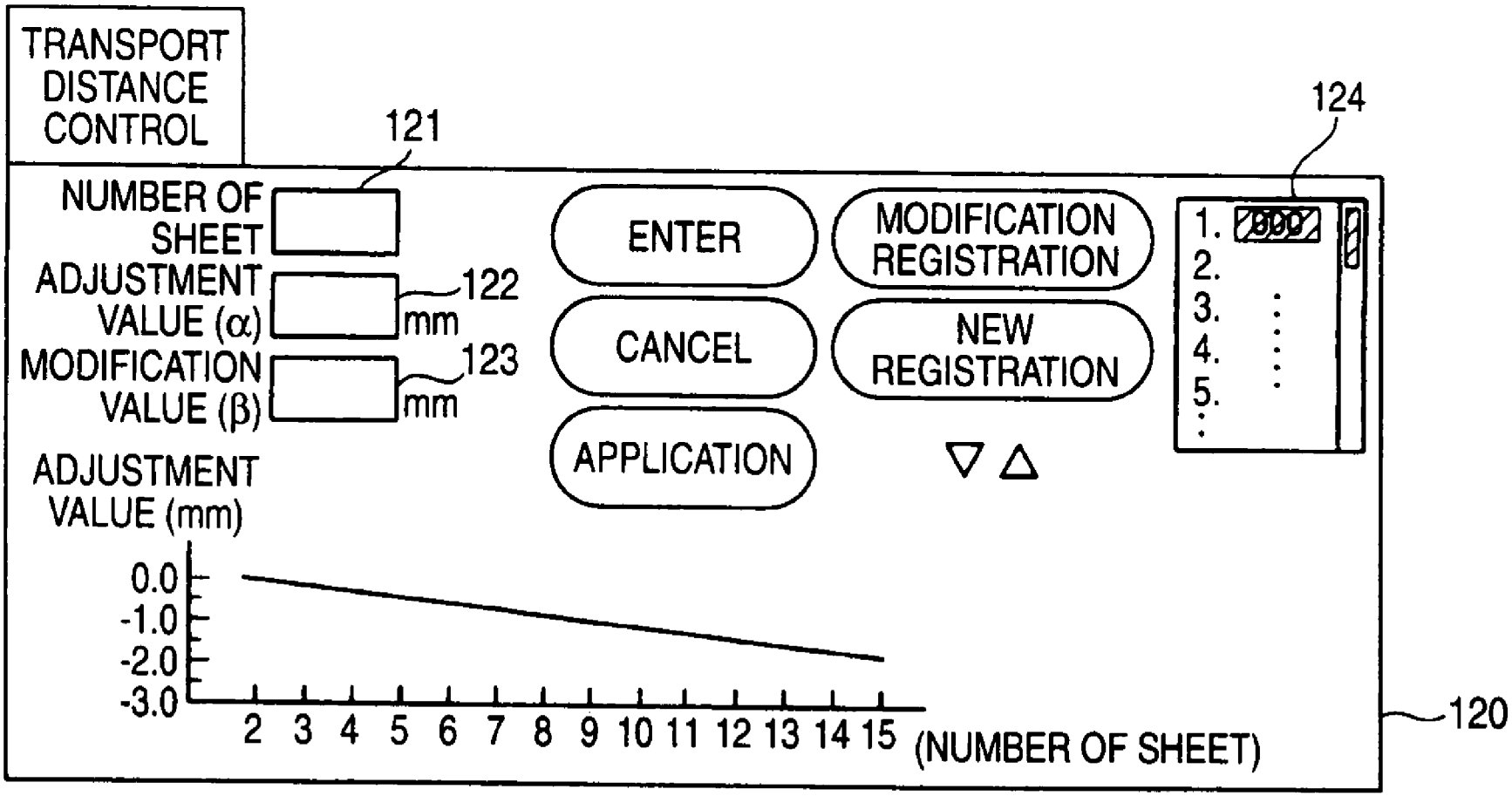
FIG. 4 is a view showing a display screen for newly registering a transport distance determination table or making a change in the transport distance determination table.

FIG. 4 is a view showing a display screen on a touch panel for newly registering or changing the details of the transport distance determination table. A display screen 120 shown in FIG. 4 is displayed by selecting an optional function "transport distance control" on the touch panel 12 provided on the image forming system 1 that is equipped with the sheet processing apparatus 11.

A paper counter box 121, into which the number of pieces of paper constituting the set of paper is to be input, is set in an upper left position on the display screen 120 shown in FIG. 4. An adjustment value ($\alpha$) box 122, by way of which the adjustment value $\alpha$ is displayed or input, is provided below the paper counter box 121. A "Modification Value ($\beta$)" box 123, by way of which a modification value $\beta$ corresponding to the value displayed in the "Adjustment Value ($\alpha$) " 122 is input, is provided below the adjustment value ($\alpha$) input box 122. At a center upper position, there is provided an "Enter" key used for storing the number of pieces of paper and an adjustment value or a modification value corresponding to the number of pieces of paper when the number of pieces of paper and the adjustment value or modification value are input. A "Cancel" key to be operated for canceling input data and a "New Registration" key to be operated in registering a relationship between the number of pieces of paper and the adjustment value ($\alpha$) as a new transport distance determination table are also provided below the "Enter" key. A "Table Display" box 124, on which the registered transport distance determination table is displayed with a registration number, is provided in an upper right position. In the "Table Display" box 124, the transport distance determination table currently applied to the sheet processing apparatus 11 is displayed with hatching. FIG. 4 shows that a transport distance determination table (registration number "000") whose details are displayed in FIG. 3B and which is registered upon shipment from a factory is applied. Details of the transport distance determination table are displayed in the form of a graph in a lower position of the display screen 120 shown in FIG. 4.

A "Modification Registration" key, which is to be operated when a modification is made to the registered transport distance determination table and is saved through overwriting, is provided in an upper center position on the display screen 120 shown in FIG. 4.

Here, when the quality of recording paper used by the user of the image forming system 1 differs from that presumed at the time of shipment, a deviation may arise between the position where stapling has been performed and a fold line made through folding operation, depending on adjustment of the transport distance according to the transport distance determination table whose details are shown in FIG. 3B.

In such a case, the sheet processing apparatus 11 can prepare a transport distance determination table appropriate to the user, and a new transport distance determination table is prepared as follows.

A deviation between the stapled position on the set of paper and the position of the fold line of the set of paper, the deviation being attributable to the currently-applied transport distance determination table, is sampled. Subsequently, optional function "Transport Distance Control" is selected on the control panel of the image forming system 1.

The number of pieces of paper to be changed is input into the "Paper Counter" box 121 of the display screen 120 shown in FIG. 4, and the "Enter" key is operated. At this time, the adjustment value (α) in the currently-applied transport distance determination table appears in the "Adjustment Value (α)" box 122. Next, the modification value (β) corresponding to the value appearing in the "Adjustment Value (α)" box 122 is input to the "Modification Value (β)" box 123, and the "Enter" key is operated. Similarly, after the modification value (β) is input for the other paper counts, and the "New Registration" key is operated. Thereby, the value input to the "Modification Value (β) box 123 is added to the value appearing in the "Adjustment Value (α)" box 122, whereupon a new transport distance determination table is registered and appears in the "Table Display" box 124. In this case, when the "Modification Registration" key is operated, the data are written over the currently-applied transport distance determination table. Provided in an upper center position of the display screen 12 are "ΔV" keys and an "Application" key, which are to be operated by selecting any one from the transport distance determination tables registered in the "Table Display" box 124.

Figure 3C:
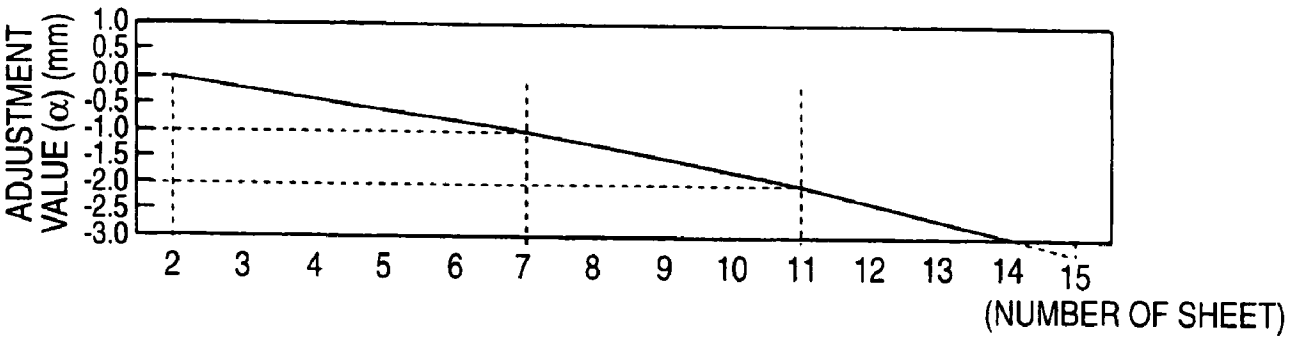

FIG. 3C shows one example of details of the newly-registered transport distance determination table in the form of a graph. Data items (2 pieces of paper, adjustment amount 0.0), (7 pieces of paper, adjustment amount −1.0), (pieces of paper 11, adjustment amount −2.0), and (pieces of paper 15, adjustment amount −3.2) are input for new registration, and adjacent data are connected together by means of a linear expression, thereby determining the adjustment value (α).

As described above, in the sheet processing apparatus 11 of this embodiment, the distance, over which the set of paper is transported from the stapling position where stapling is performed to the folding position where folding is performed, is determined by reference to a transport distance determination table 116*a* in which the number of pieces of paper forming the set of paper and the adjustment value (α) are stored. This transport distance determination table 116*a* is rewritable through operation on the display screen 120. Consequently, according to the sheet processing apparatus 11 of this embodiment, the transport distance to which a deviation stemming from an increase in the number of pieces of paper is added can be associated with the number of pieces of paper in the transport distance determination table. As a result, a deviation between the stapled position of the set of paper and the position of a fold line made on the set of paper can be kept small.

The previously-described embodiment has been described by means of taking, as an example, a case where the sheet processing apparatus is provided with the display screen 120 by way of which operation for writing a transport distance is performed. However, the present invention is not limited to this embodiment. The transport distance determination table may be received from the outside over a communications line. Alternatively, plural types of unrewritable transport determination tables may be provided, and a transport distance determination table most suitable for the quality of paper used selected and applied. Moreover, the advantage of the present invention is not diminished even when sheet-like materials other than paper are used.

As described so far, some aspects of the present invention have been conceived while paying attention to a conventional sheet processing apparatus which folds a set of stapled sheets in half, wherein the position where a folded line is to be formed deviates from the center of the set of sheets with a certain tendency as the number of sheets forming a set of sheets becomes larger even when an attempt is made to fold the center of the set of sheets as in the case where a smaller number of sheets form a set of sheets. Specifically, in the sheet processing apparatus of the present invention, the sheet transport mechanism transports the set of sheets from the stapling position by a distance determined by reference to the transport distance determination table, according to the number of sheets forming the set of sheets. According to the sheet processing apparatus of the present invention, the transport distance which is determined in consideration of the amount of deviation stemming from an increase in the number of sheets can be associated with the number of sheets in the transport distance determination table. As a result, a deviation between the stapled position on the set of sheets and the position of the folded line of the set of sheets made through folding can be prevented.

The foregoing description of the embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

The entire disclosure of Japanese Patent Application No. 2004-231949 filed on Aug. 9, 2004 including specification, claims, drawings and abstract is incorporated herein by reference in its entirety.

What is claimed is:

1. A sheet processing apparatus which stacks sheets sequentially fed one by one, binds a center of a plurality of stacked sheets, and folds the thus-bound set of sheets in half, the apparatus comprising:

a stapler which binds the center of the plurality of stacked sheets;

a sheet folding mechanism which folds the set of sheets bound by the stapler in half;

a sheet number recognizing portion which recognizes a number of sheets forming the set of sheets;

a sheet transport mechanism which transports the set of sheets bound by the stapler to a position where a center of the set of sheets is folded by the sheet folding mechanism;

a sheet transfer control portion which transports the set of sheets by a transport distance determined according to the number of sheets forming the set of sheets, which is recognized by the sheet number recognizing portion: and wherein the sheet transfer control portion includes a transport distance determination table in which the number of sheets forming the set of sheets is associated with a transport distance by which the sheet transport mechanism transports the set of sheets.

2. The sheet processing apparatus according to claim 1, wherein the transport distance determination table is rewritable.

3. The sheet processing apparatus according to claim 1, further comprising an operating portion which performs an operation for writing a transport distance into the transport distance determination table according to the number of sheets.

4. The sheet processing apparatus according to claim 2, further comprising an operating portion which is performed operation for writing a transport distance into the transport distance determination table according to the number of sheets.

5. The sheet processing apparatus according to claim 1 wherein the sheet transfer control portion includes a plurality of transport distance determination tables, the transport distance determination tables being unrewritable and corresponding to plural types of paper qualities.

6. The sheet processing apparatus according to claim 5, further comprising an operating portion which performs an operation for writing a transport distance into one of the plurality of transport distance determination tables according to the number of sheets.

* * * * *